US006536196B2

(12) United States Patent
Harrison et al.

(10) Patent No.: US 6,536,196 B2
(45) Date of Patent: Mar. 25, 2003

(54) STRAPLESS SPUR

(76) Inventors: Kelly Harrison, 3404 Merrimac Rd., Brentwood, CA (US) 90049; David Schneider, 3404 Merrimac Rd., Brentwood, CA (US) 90049

( * ) Notice: Subject to any disclaimer, the term of this patent is extended or adjusted under 35 U.S.C. 154(b) by 0 days.

(21) Appl. No.: 09/929,421

(22) Filed: Aug. 14, 2001

(65) Prior Publication Data

US 2003/0033789 A1 Feb. 20, 2003

(51) Int. Cl.[7] ..... A43C 17/00; A43C 17/04
(52) U.S. Cl. ..... 54/83.1; 54/83.2; D30/157
(58) Field of Search ..... 54/83.1, 83.2; D30/157; 36/131, 132

(56) References Cited

U.S. PATENT DOCUMENTS

| | | | | | |
|---|---|---|---|---|---|
| 39,106 | A | * | 6/1863 | Langholz | 54/83.2 |
| 78,667 | A | | 6/1868 | Herr | |
| 86,049 | A | | 1/1869 | Woodruff | |
| 113,152 | A | * | 3/1871 | Fellows | 54/83.1 |
| 116,404 | A | * | 6/1871 | Bohn | 54/83.1 |
| 225,955 | A | * | 3/1880 | Tytler | 54/83.1 |
| 256,606 | A | | 4/1882 | Thomson | |
| 450,512 | A | | 4/1891 | Hutt | |
| 701,854 | A | | 6/1902 | Davison | |
| 722,046 | A | | 3/1903 | Rieger | |
| 2,438,978 | A | | 4/1948 | Rosen | |
| 2,454,228 | A | * | 11/1948 | Smith | 54/83.1 |
| 4,642,910 | A | * | 2/1987 | Carter, Jr. et al. | 54/83.1 |
| D352,805 | S | * | 11/1994 | Martin | D30/157 |

FOREIGN PATENT DOCUMENTS

| | | |
|---|---|---|
| DE | 5848 | 12/1878 |
| DE | 6549 | 2/1879 |
| DE | 59076 | 4/1891 |
| DE | 72313 | 3/1893 |
| DE | 180197 | 12/1905 |

* cited by examiner

*Primary Examiner*—Charles T. Jordan
*Assistant Examiner*—Elizabeth Shaw

(57) ABSTRACT

A strapless spur system having a base attached to a boot or other footwear, the spur assembly mating with the base on the footwear. A preferred embodiment includes a base that is threaded and built into the boot, and a knurled annular base to assist in mounting the spur to the base or retainer. The spur assembly may also be attached by a mounting plate and have a telescoping spur.

21 Claims, 10 Drawing Sheets

STRAPLESS SPUR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates generally to the field of boot spurs for riders of animals, and more particularly to a strapless spur attached to a boot or other footwear.

Horseman and cowboys have long attached spurs to their boots as a practical and fashionable accessory. A conventionally designed English spur has a generally U-shaped metal member, referred to as a band, that fits about the rear of the rider's boot adjacent the heel and has a rearward projection which often carries a point or a rowel having a multiplicity of points. In conventional designs, each English spur normally has one strap that is inserted through one end of the band, passed underneath the boot's heal, and passed through the opposite end of the band and serves to releasably attach the spur to the rider's boot. The typical spur mounting apparatus attaches firmly to the boot by the use of clamps, chain or the like, so as to rigidly hold the spurs in their proper position behind the heel of the boot.

Prior spur designs have included means to prevent the riding up of the spur to prevent misalignment of the spur and thus detracting from one of its purposes of stable engagement to the boot. Attaching additional upper straps to the band or including a ridge element that can be wedged between the heel of the boot and the upper portion of the boot are two examples of such designs.

These arrangements tend to allow the spur mounting apparatus to "ride-up" the boot, out of its useful position. To counteract this tendency boot wearers will increase the tension on the mounting apparatus sometimes cutting or otherwise damaging the boot leather.

BRIEF SUMMARY OF THE INVENTION

An object of the invention is to provide a spur that is integrated with the footwear.

Another object of the invention is to provide a spur that can be removed from attached footwear.

Another object of the invention is to provide a spur that maintains its optimal operating position, i.e., does not "ride up" or move out of position during use.

A further object of the invention is to provide a spur that is integrated with the footwear and operates with out a disc rowel.

Yet another object of the invention is to provide a spur that is integrated with the footwear and reduces discomfort for the ridden animal.

Still yet another object of the invention is to provide a spur system that can be easily retracted when not in use.

The strapless spur is an innovation that is simple in design and overcomes the tendency of conventional spurs to move out of the optimal position during prolonged use.

The strapless spur is intended for use in specially manufactured footwear including boots, which have either the strapless spur or fixed retainer built into the footwear. The retainer or spur is installed on the rear foot portion of the footwear above the heel.

In the fixed retainer models the strapless spur is intended for use in conjunction with footwear having a fixed retainer installed on the rear foot portion of the footwear above the heel. The strapless spur attaches to the fixed retainer and maintains the spur in the optimal operating position.

In the telescoping strapless spur models the strapless spur itself is installed on the rear foot portion of the footwear above the heel. The telescoping strapless spur maintains the spur in the optimal operating position by virtue of its fixed position built into the footwear.

In accordance with a preferred embodiment of the invention, there is disclosed a strapless spur having a base or retainer attached to a boot or other footwear; a means for attaching the spur to the base or retainer, the spur having a longitudinal member; and the spur having a mechanism for attachment of spur to the base or retainer.

In accordance with another preferred embodiment of the invention, there is disclosed a strapless spur having a base or retainer attached to a boot or other footwear and a curved plate for mating with the base or retainer on the footwear.

In accordance with another preferred embodiment of the invention, there is disclosed a strapless spur having a base or retainer attached to a boot or other footwear; a telescoping longitudinal member extending from the base outward from the footwear; and a spur permanently attached to the telescoping longitudinal member.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIGS. 10C and 10E are side views of the boot mounted mating area for a spur in an alternative embodiment of the invention.

DETAILED DESCRIPTION OF THE PREFERRED EMBODIMENTS

Detailed descriptions of the preferred embodiments are provided herein. It is to be understood, however, that the present invention may be embodied in various forms. Various aspects of the invention may be inverted, or changed in reference to specific part shape and detail, part location, or part composition. Therefore, specific details disclosed herein are not to be interpreted as limiting, but rather as a basis for the claims and as a representative basis for teaching one skilled in the art to employ the present invention in virtually any appropriately detailed system, structure or manner.

Figures 1A, 1B, 1C:
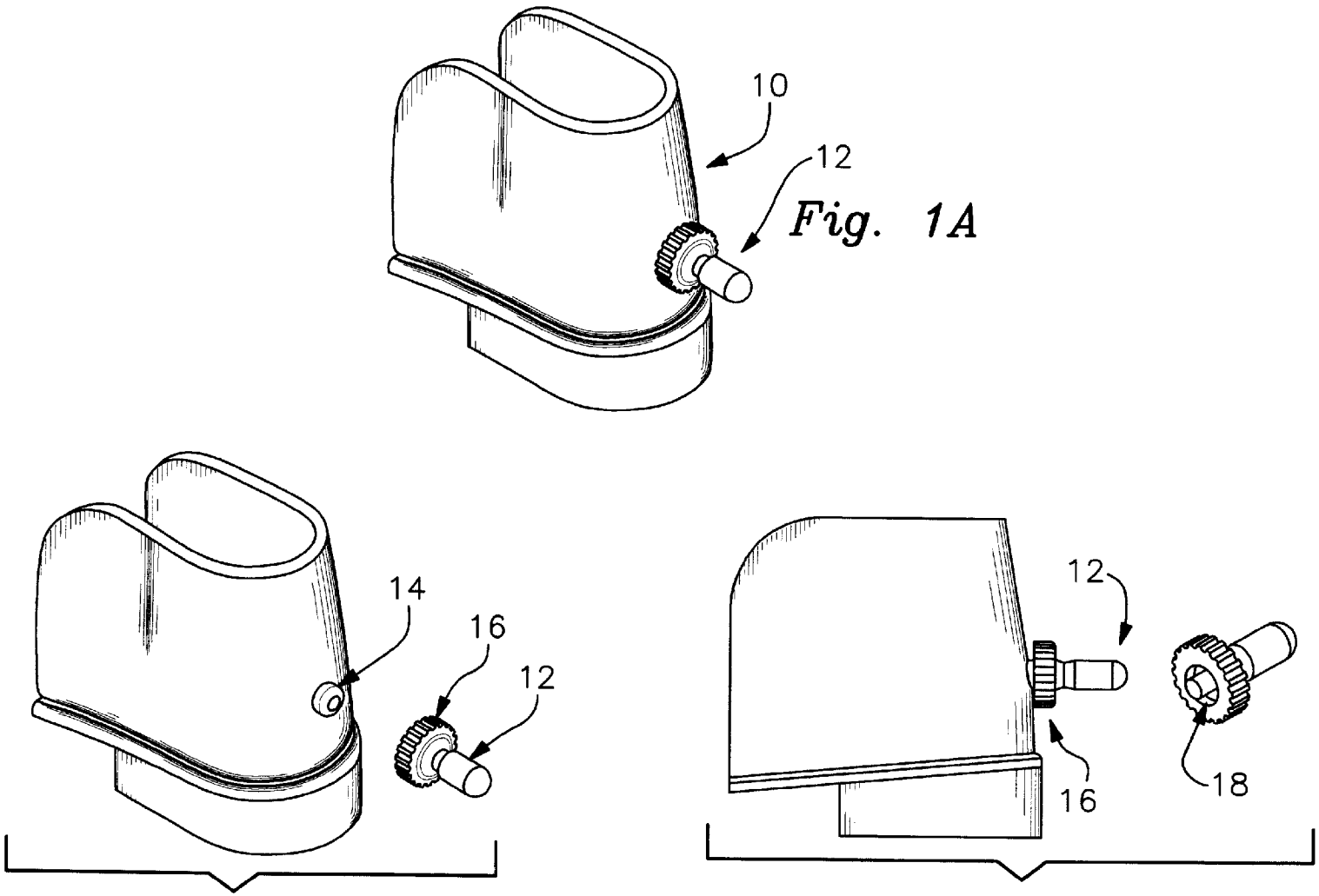
FIG. 1A is a perspective view of the invention.
FIG. 1B is an exploded view of the invention.
FIG. 1C is a side elevation view of the invention.

Referring now to FIGS. 1A, B, and 1C there is shown an article of footwear 10, exemplarily shown herein as a conventional boot. It is well understood in the art that such footwear may be a riding boot, a cowboy boot, or any other footwear upon which a spur may be advantageously used.

According to a preferred embodiment of the present invention, footwear 10 contains retainer or base apparatus 14 (see also FIGS. 2B at 20; 3A at 36; 4B–C at 44; 5A–C at 56; 6B at 62; 8B and 8C at 84; and 10A–E at 100), that is built into footwear 10 either at the time of manufacture or as an addition to the boot. Base apparatus 14 is attached by conventional means such as mating threaded insert and screw in post, or any other mechanism that fixably attaches the base to the back of the boot. Retainer or base 14 is specially adapted to rigidly hold spur 12 in place. As described in greater detail herein below, spur 12 is adapted to be removably attached to retainer or base 14. However, spur 12 may be permanently attached to retainer or base 14 and thus the boot by means such as nailing or riveting.

In a first embodiment of the present invention, an elongated longitudinal member and rounded point comprise spur 12. The mating end of spur 12 has a knurled surface 16 to aid in attaching and detaching the spur from retainer or base 14. Inner annulus 18 of knurled mating end 16 of spur 12 may be threaded as could be retainer or base 14 on footwear 10 for mating spur 12 to base 14. Spur 12 may be secured to base or retainer 14 by screwing spur 12 onto base or retainer 14. Other mechanisms of attachment may be used such as a clip on attachment, a spring-loaded annulus with roller balls inside the annulus 18 or other conventional attachment means.

Figure 2C:
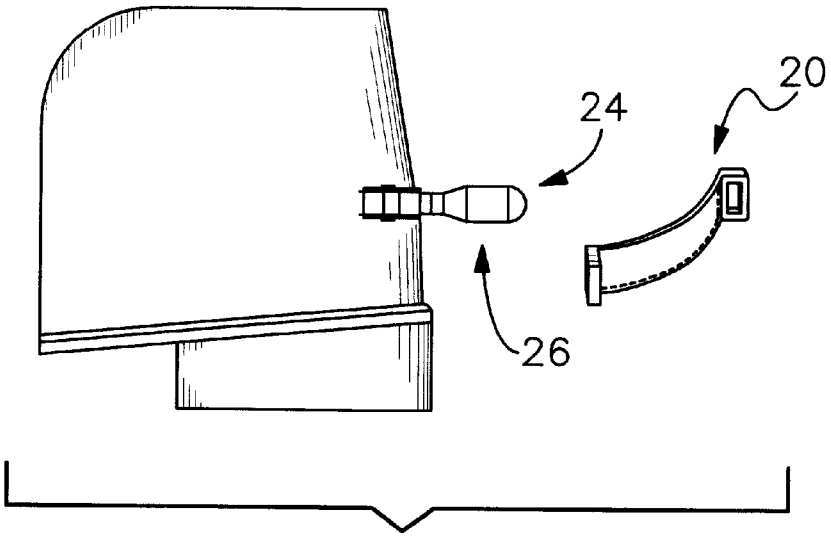
FIG. 2C is a side elevation view of an alternative embodiment of the invention.
Figure 2A:
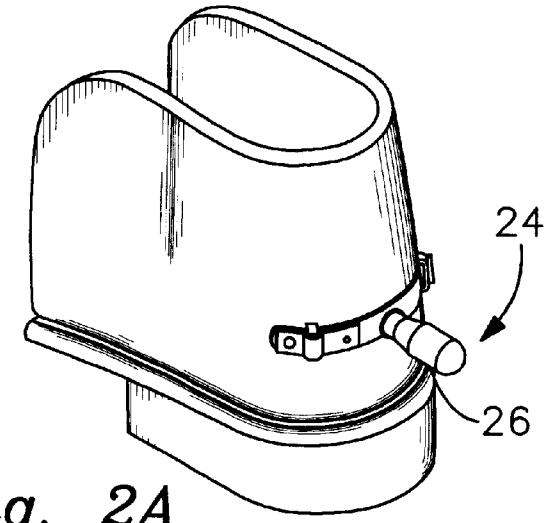
FIG. 2A is a perspective view of an alternative embodiment of the invention.
Figure 2B:
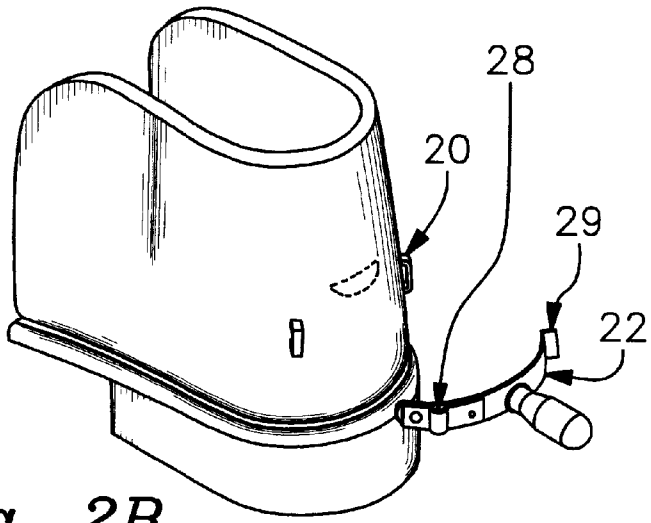
FIG. 2B is an exploded perspective view of an alternative embodiment of the invention.

In the embodiment as shown in FIGS. 2A, 2B and 2C, retainer or base 20 consists of a single cast metal plate, which is placed in the rear portion of the footwear above the heel. Retainer or base 20 is permanently installed during the footwear manufacture but may be later attached. The only exposed portion of retainer or base 20 are the exposed loops, which are used to hold in place spur plate 22. Spur 26 can be attached to spur plate 22 as shown in the previous embodiment of FIGS. 1A, 1B, and 1C, or permanently attached to spur plate 22 during manufacture by welding, brazing or other metallurgic techniques. Spur plate 22 is secured in place by first sliding spur plate lip 29 through one of the retainer plate loops. Spur plate 22 is then moved laterally towards the other retainer plate loop. Flexible metal loop 28 on spur plate 22 is then lifted off spur plate 22, over retainer plate 20 loop, and then released, snugly securing spur plate 22 and spur 26 to the footwear. In this illustration, spur point 24 is rounded but may be of any configuration to achieve the desired spurring purpose.

Figure 3A:
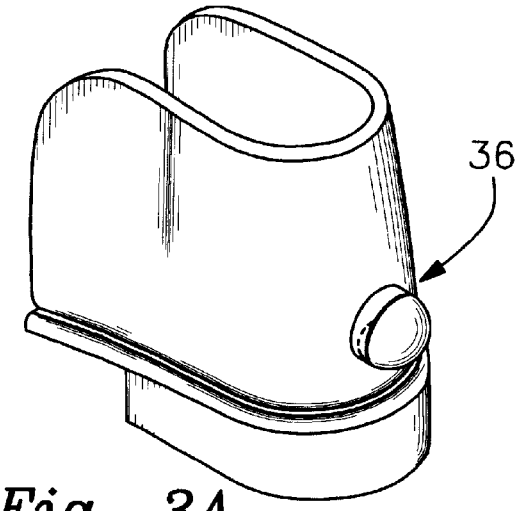
FIGS. 3A and 3B are perspective views of an alternative embodiment of the invention.
Figure 3B:
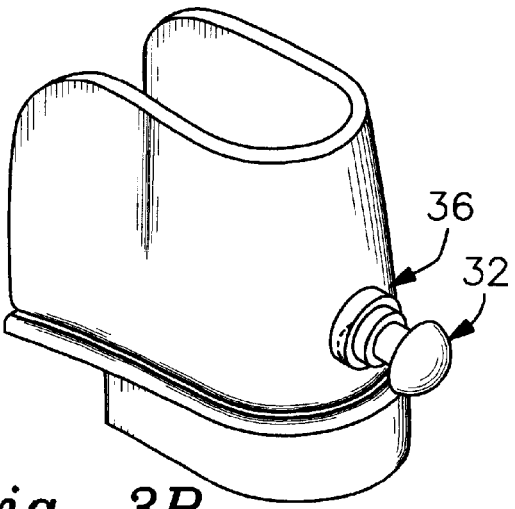
Figure 3C:
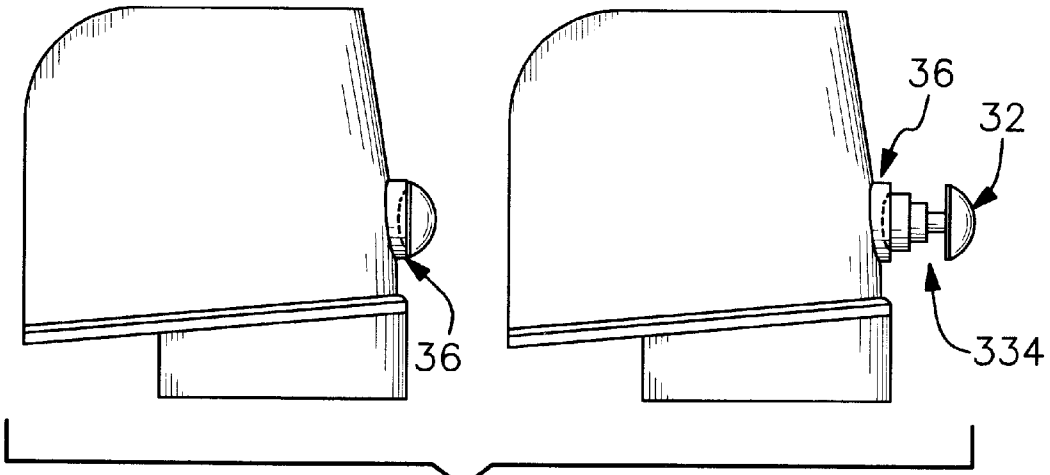
FIG. 3C is a side elevation view of an alternative embodiment of the invention.

In the embodiment as shown in FIGS. 3A, 3B and 3C, retainer or base 36 is again permanently attached to the footwear and has integrated spur point 32. Telescopic longitudinal member 34 is attached to retainer or base 36 using one of the methods previously described. In this embodiment, spur point 32 is rounded and attached to telescopic longitudinal member 34. As shown in FIG. 3C spur 32 can be extended or retracted from the retainer or base 36. Methods for extending spur 32 include utilizing a spring mechanism inside the telescopic longitudinal member. Longitudinal member 34 may preferably have a variable locking mechanism to maintain the longitudinal member in its outward telescoped position during use with the ability to retract the member when not in use.

Figure 4B:
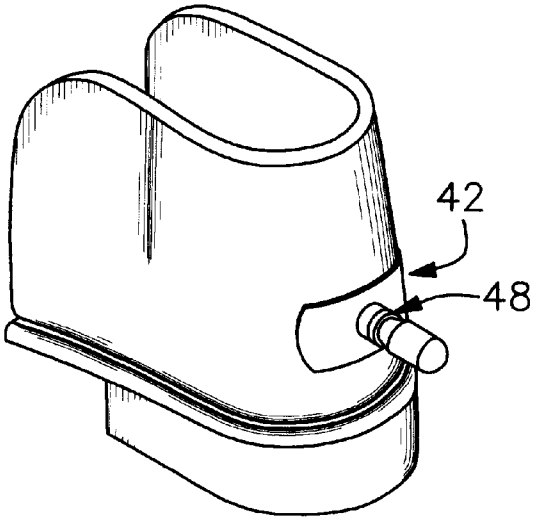
FIG. 4B is a perspective view of an alternative embodiment of the invention.
Figure 4A:
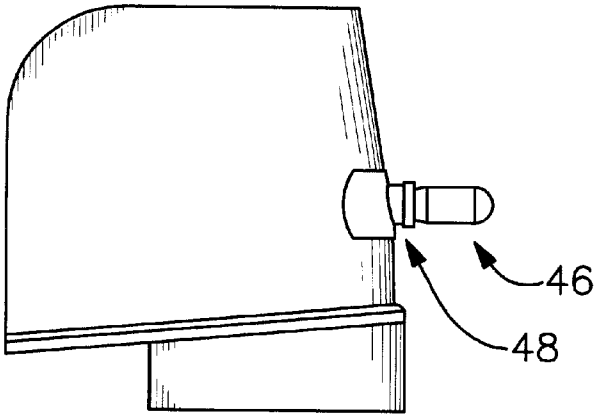
FIG. 4A is a side elevation view of an alternative embodiment of the invention.
Figure 4C:
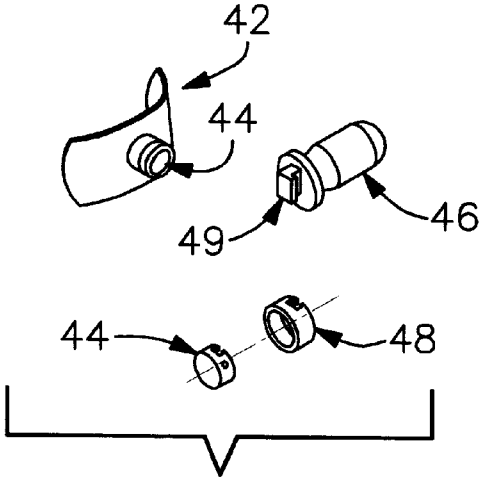
FIG. 4C is an exploded view of an alternative embodiment of the invention.

FIGS. 4A and 4B show another variation of retainer or base 42 and method for attaching spur 46 to retainer or base 42. In this variant, annular metal button 44 is permanently attached to retainer or base 42 by welding, brazing or other metallurgic techniques. Metal button 44 contains a T-shaped notch on the exposed side. Metal button 44 is covered by a similarly slotted metal ring 48 that covers the side of the button and can be twisted to align the notch on the ring with the notch on the button. Spur 46 in this variant is fitted with a permanently attached rectangular bar with T-shaped lip 49. T-shaped lip 49 fits inside button 44 and ring 49. When twisted into the locking position, ring 49 provides a secure fit for spur 46 on retainer or base 42.

Figure 5C:
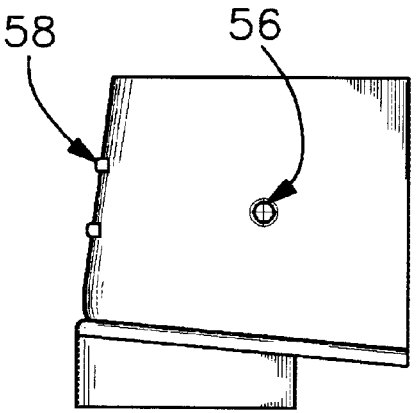
FIG. 5C is a side elevation view of an alternative embodiment of the invention.
Figure 5B:
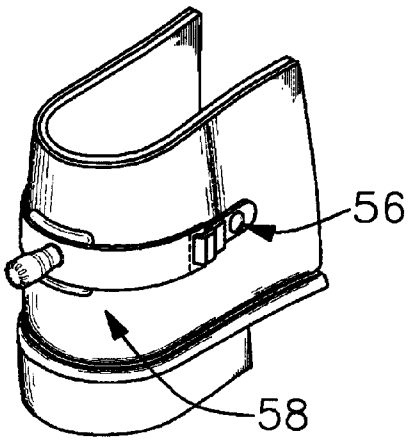
FIGS. 5A and 5B are perspective views of an alternative embodiment of the invention.
Figure 5A:
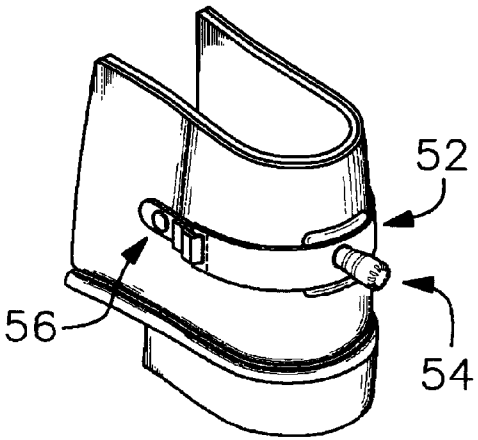

FIGS. 5A, 5B, and 5C show an additional way to secure spur plate 52 to the footwear through use of snaps 56 attached to a retainer or base built into the footwear. To ensure stable positioning of spur plate 52 and spur 54, two risers 58 may be built into the footwear and mounted horizontally just above and below the optimum position of spur plate 52. In the preferred embodiment of this variant, risers 58 are sewn into the footwear and are made of the same leather as the boot.

Figure 6B:
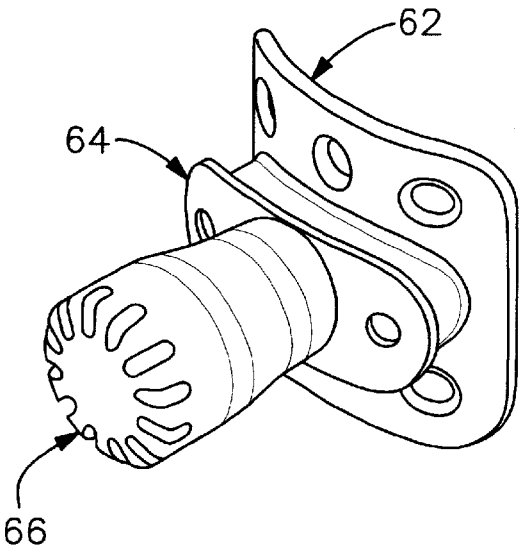
FIG. 6B is a perspective view of an alternative embodiment of the invention.
Figure 6A:
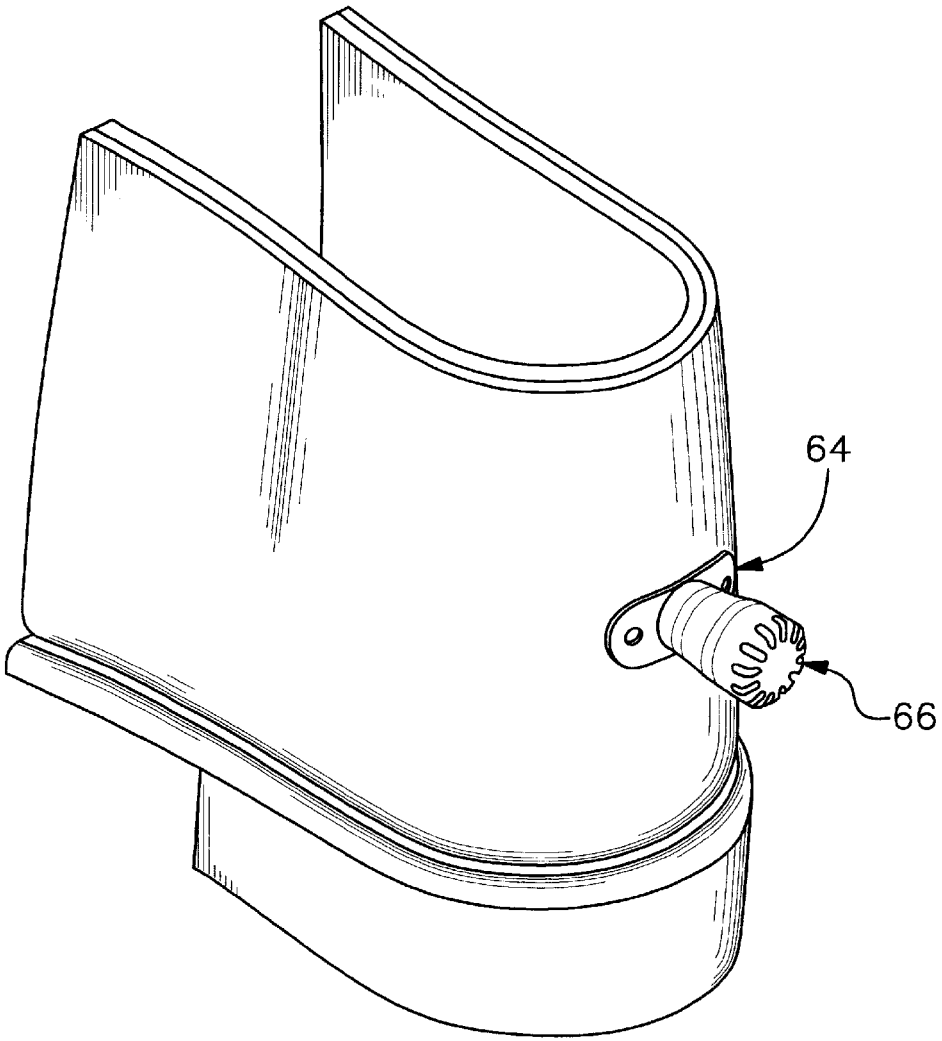
FIG. 6A is a perspective view of an alternative embodiment of the invention.

In the embodiment shown in FIGS. 6A and 6B, retainer or base 62 is built into the footwear and integrated spur 64 is then attached to base 62 by means of screws or rivets. This illustration shows knurled spur point 66 for easy handling and use as a spur.

Figure 7B:
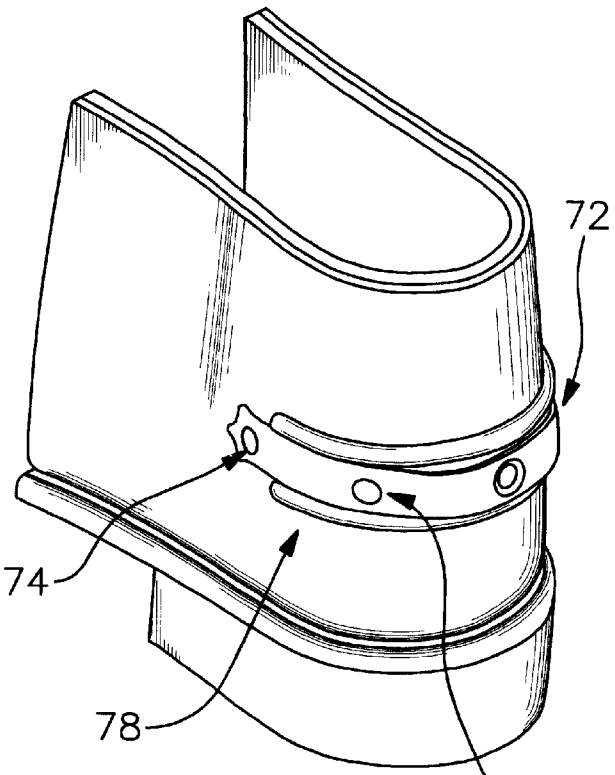
FIG. 7B is a perspective view of an alternative embodiment of the invention.
Figure 7A:
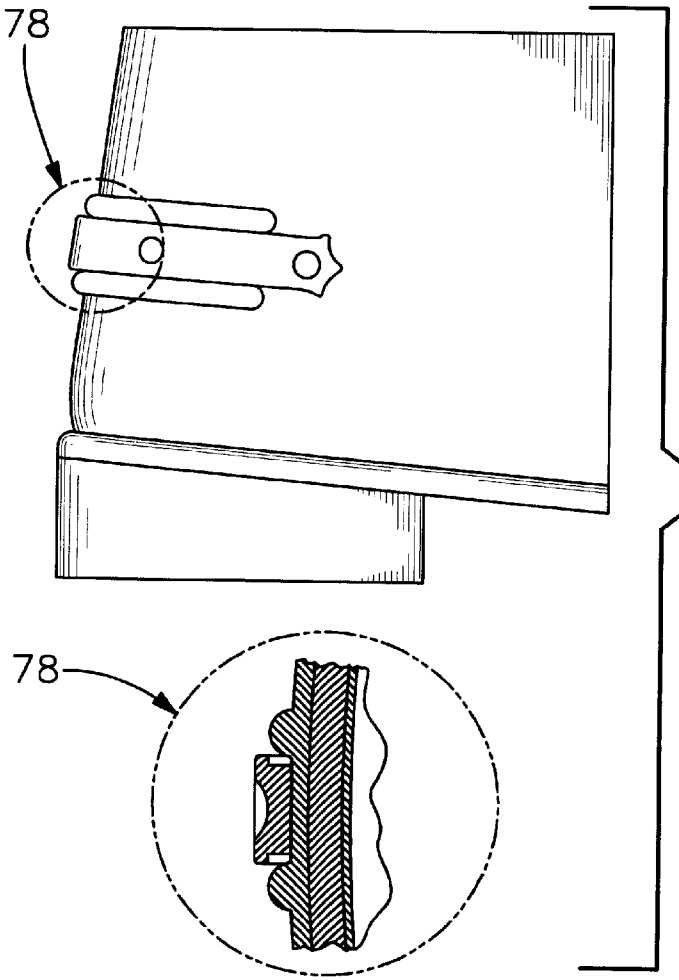
FIG. 7A is a cross sectional view of an alternative embodiment of the invention.
Figure 8B:
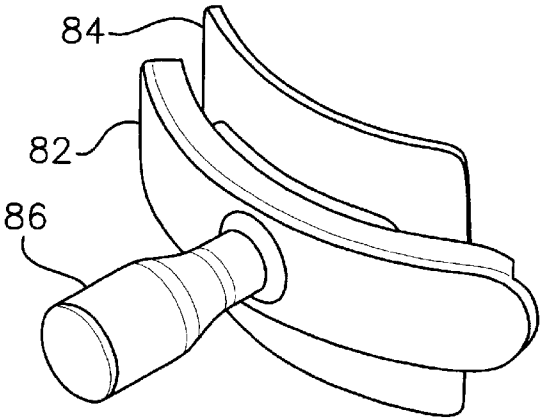
FIGS. 8A and 8B are perspective views of an alternative embodiment of the invention.
Figure 8C:
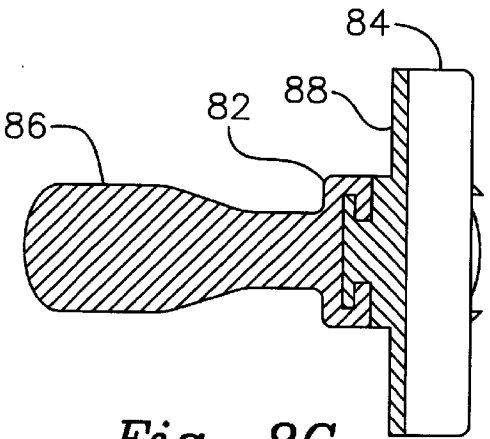
FIG. 8C is a cross sectional view of an alternative embodiment of the invention.
Figure 8A:
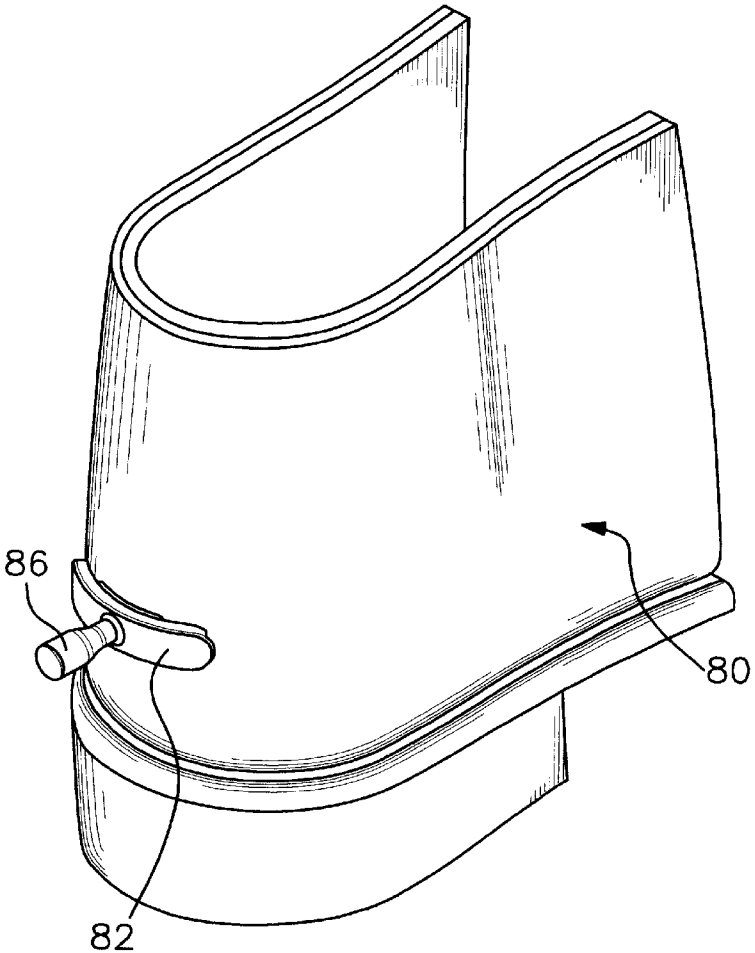
Figure 9A:
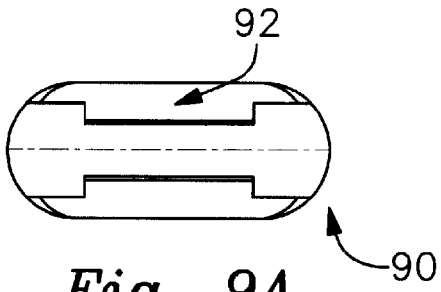
FIG. 9A is a back view of the mating area of the spur in an alternative embodiment of the invention.
Figure 9B:
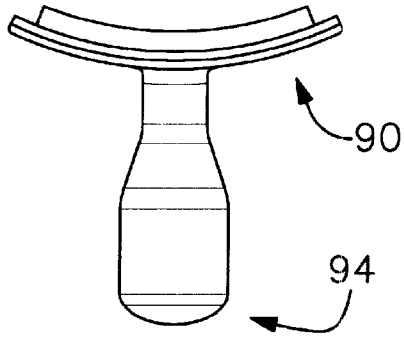
FIG. 9B is a top view of the spur in an alternative embodiment of the invention.
Figure 9C:
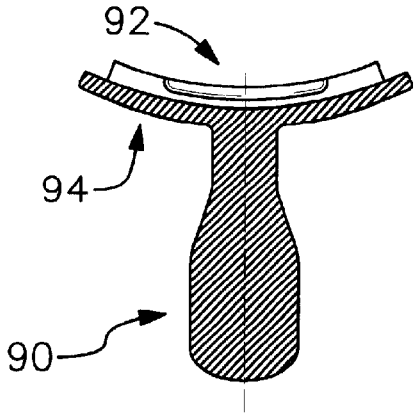
FIG. 9C is a top cross sectional view of the spur in an alternative embodiment of the invention.
Figure 9D:
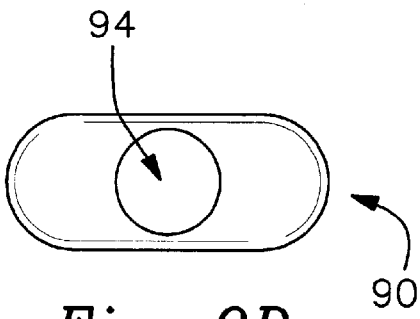
FIG. 9D is a front view of the spur in an alternative embodiment of the invention.
Figure 9E:
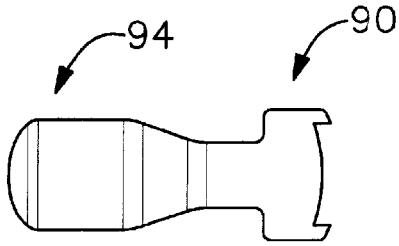
FIG. 9E is a side view of the spur in an alternative embodiment of the invention.
Figure 10A:
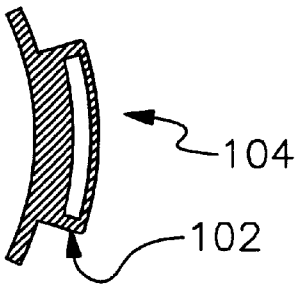
FIG. 10A is a top cross sectional view of the boot mounted mating area for a spur in an alternative embodiment of the invention.
Figure 10B:
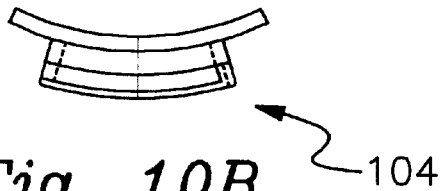
FIG. 10B is a top view of the boot mounted mating area for a spur in an alternative embodiment of the invention.
Figure 10C:
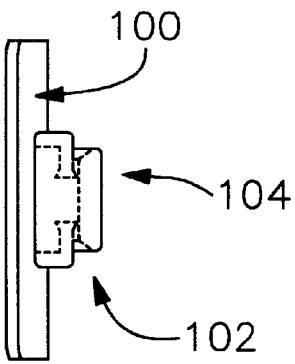
Figure 10D:
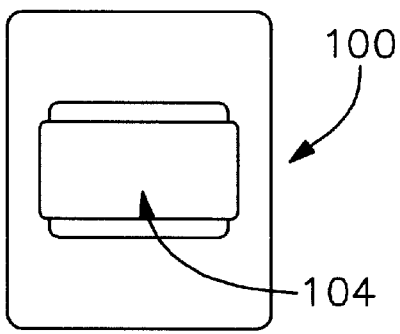
FIG. 10D is a top view of the boot mounted mating area for a spur in an alternative embodiment of the invention.
Figure 10D:
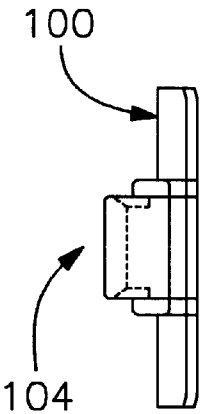

In the embodiment shown in FIGS. 7A and 7B, riser 78 has upper and lower protrusions that maintain spur plate 72 in position and helps keep in place spur plate 72 firmly attached on the boot. Spur plate 72 is secured to a retainer or base by means of a series of snaps or rivets 76. In this illustration the spur (not shown) may be attached by means of a threaded spur screwed into the spur plate, a slotted engagement or other suitable attachment means.

In the embodiment shown in FIGS. 8A through 10E, retainer or base 84, 100 consists of a single cast metal plate, which is placed in the rear portion of the footwear above the heel. Retainer or base 84, 100 is permanently installed during the footwear manufacture but may be later attached. The exposed portion of retainer or base 84, 100 is mating plate 104 which has grooved or slotted areas 102 to firmly attach spur 86, 94 and spur plate 82, 90. Inner surface of the spur plate 92 is milled or cut to securely fit into grooves or slots 102 on mating plate 88, 104. Spur 86, 94 can be attached to spur plate 82, 90 as shown in is the previous embodiment of FIGS. 1A, 1B, and 1C, or permanently attached to spur plate 82, 90 during manufacture by welding, brazing or other metallurgic techniques. Spur plate 82, 90 is secured in place lining up inner surface of the spur plate 92 to grooves or slots 102 on the mating plate 88, 104 then sliding spur plate 82, 90 on to mating plate 88, 104. In these illustrations spur point 86 is rounded but may be of any configuration to achieve the desired spurring purpose.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A strapless spur comprising:

a rigid base attached to the rear of the footwear upper;

a spur having a longitudinal member for engagement to said base;

said spur being adapted for stable engagement to said base.

2. A strapless spur as claimed in claim 1 wherein said longitudinal member has an annular portion with a knurled surface.

3. A strapless spur as claimed in claim 2 wherein said knurled surface is at the exposed end of the spur.

4. A strapless spur as claimed in claim 1 wherein said annular portion is internally threaded for engagement to a mating threading on the base.

5. A strapless spur as claimed in claim 1 wherein said annular portion releasably engages the base.

6. A strapless spur as claimed in claim 1 further comprising a notched slot on the base for reception of a mating spur.

7. A strapless spur as claimed in claim 1 further comprising a retaining plate attached to the spur.

8. A strapless spur comprising:

a base attached to an article of footwear;

a spur having a longitudinal member for engagement to said base;

said spur being adapted for stable engagement to said base;

a notched slot on the base for reception of a mating spur; and a generally rectangular bar with a T shaped lip attached to said spur;

wherein said spur slides into said notched slot on the base for secure attachment.

9. A strapless spur comprising:

a base attached to an article of footwear;

a spur having a longitudinal member for engagement to said base;

said spur being adapted for stable engagement to said base;

said longitudinal member having an annular portion; and a ring that locks around the annular portion of the spur for attachment of said spur to the base.

10. A strapless spur comprising:

a base attached to an article of footwear; and spur assembly having a curved plate for mating with the base on the footwear.

11. A strapless spur comprising:

a base attached to an article of footwear;

spur assembly having a curved plate for mating with the base on the footwear;

said base having a curved retainer plate with two ends with open loops for attachment of said spur assembly;

said spur assembly has a first end loop for attachment to a retainer post on said footwear; and said spur assembly has a second end with a lip which secures the spur assembly when placed through an open loop of the curved retainer plate.

12. A strapless spur as claimed in claim 11 wherein said spur assembly curved plate has an extended protrusion with a blunt end.

13. A strapless spur as claimed in claim 11 further comprising a spur base attached to said curved plate;

a spur attached to said base, wherein said spur has an annular portion for attachment of spur to the base.

14. A strapless spur comprising:

a base attached to an article of footwear;

spur assembly having a curved plate for mating with the base on the footwear wherein said base has a fastening snap integrated into the footwear.

15. A strapless spur comprising:

a base attached to an article of footwear;

spur assembly having a curved plate for mating with the base on the footwear wherein said base has a fastening snap integrated into the footwear; and two risers built into the rear of footwear mounted horizontally to receive said spur assembly curved plate.

16. A strapless spur as claimed in claim 15 wherein said risers are made of leather.

17. A strapless spur as claimed in claim 15 wherein said spur assembly curved plate is attached to the footwear by rivets.

18. A strapless spur comprising:

a base attached to a boot or other footwear;

a telescoping longitudinal member extending from the base outward from the footwear; and a spur attached to the telescoping longitudinal member.

19. A strapless spur as claimed in claim 18 wherein said spur can be extended from or retracted into said base or retainer.

20. A strapless spur as claimed in claim 19 further comprising a spring mechanism for extension or retraction of the spur.

21. A strapless spur comprising:

a base attached to an article of footwear;

a spur having a longitudinal member for engagement to said base;

said spur being adapted for stable engagement to said base;

a T shaped lip on the base for reception of a mating spur;

a generally rectangular bar with a notched slot attached to said spur; and wherein said spur slides into said T shaped lip on the base for secure attachment.

* * * * *